US005584652A

United States Patent [19]

Shaffer et al.

[11] Patent Number: 5,584,652

[45] Date of Patent: Dec. 17, 1996

[54] CERAMIC TURBINE NOZZLE

[75] Inventors: James E. Shaffer, Maitland, Fla.; Paul F. Norton, San Diego, Calif.

[73] Assignee: Solar Turbines Incorporated, San Diego, Calif.

[21] Appl. No.: 369,245

[22] Filed: Jan. 6, 1995

[51] Int. Cl.[6] ..... F01D 9/02

[52] U.S. Cl. ..... 415/115; 415/137; 415/191; 415/209.4

[58] Field of Search ..... 415/115, 137, 415/139, 190, 191, 209.4, 210.1

[56] References Cited

U.S. PATENT DOCUMENTS

| | | | |
|---|---|---|---|
| 3,619,077 | 11/1971 | Wile et al. | 415/115 |
| 3,650,635 | 3/1972 | Wachtell et al. | 415/115 |
| 3,857,649 | 12/1974 | Schaller et al. | 415/137 |
| 4,026,659 | 5/1977 | Freeman, Jr. | 415/115 |
| 4,076,451 | 2/1978 | Jankot | 415/209.4 |
| 4,464,094 | 8/1984 | Gerken | 415/209.4 |
| 4,643,636 | 2/1987 | Libertini et al. | 415/209.4 |

FOREIGN PATENT DOCUMENTS

| | | | |
|---|---|---|---|
| 958888 | 2/1957 | Germany | 415/209.4 |
| 56-34930 | 4/1981 | Japan | 415/115 |
| 996773 | 6/1965 | United Kingdom | 415/209.4 |
| 1554963 | 10/1979 | United Kingdom | 415/209.4 |

*Primary Examiner*—James Larson
*Attorney, Agent, or Firm*—Larry G. Cain

[57] ABSTRACT

A turbine nozzle and shroud assembly having a preestablished rate of thermal expansion is positioned in a gas turbine engine and being attached to conventional metallic components. The metallic components having a preestablished rate of thermal expansion being greater than the preestablished rate of thermal expansion of the turbine nozzle vane assembly. The turbine nozzle vane assembly includes a plurality of segmented vane defining a first vane segment and a second vane segment. Each of the first and second vane segments having a vertical portion. Each of the first vane segments and the second vane segments being positioned in functional relationship one to another within a recess formed within an outer shroud and an inner shroud. The turbine nozzle and shroud assembly provides an economical, reliable and effective ceramic component having a preestablished rate of thermal expansion being less than the preestablished rate of thermal expansion of the other component.

11 Claims, 4 Drawing Sheets

CERAMIC TURBINE NOZZLE

"The Government of the United States of America has rights in this invention pursuant to Contract No. DE-AC02-92CE40960 awarded by the U.S. Department of Energy."

TECHNICAL FIELD

This invention relates generally to a gas turbine engine and more particularly to a turbine nozzle being made of a ceramic material.

BACKGROUND ART

In operation of a gas turbine engine, air at atmospheric pressure is initially compressed by a compressor and delivered to a combustion stage. In the combustion stage, heat is added to the air leaving the compressor by adding fuel to the air and burning it. The gas flow resulting from combustion of fuel in the combustion stage then expands through a nozzle which directs the hot gas to a turbine blade, delivering up some of its energy to drive the turbine and produce mechanical power.

In order to increase efficiency the nozzle has a preestablished aerodynamic contour. The axial turbine consists of one or more stages, each employing one row of stationary nozzle guide vanes and one row of moving blades mounted on a turbine disc. The aerodynamically designed nozzle guide vanes direct the gas against the turbine blades producing a driving torque and thereby transferring kinetic energy to the blades.

The gas typically entering through the nozzle is directed to the turbine at a rotor entry temperature from 850 degrees to at least 1200 degrees Centigrade. Since the efficiency and work output of the turbine engine are related to the entry temperature of the incoming gases, there is a trend in gas turbine engine technology to increase the gas temperature. A consequence of this is that the materials of which the nozzle vanes and blades are made assume ever-increasing importance of elevated temperature capability.

Historically, nozzle guide vanes and blades have been made of metals such as high temperature steels and, more recently, nickel/cobalt alloys. Furthermore, it has been found necessary to provide internal cooling passages in order to prevent oxidation. It has been found that ceramic coatings can enhance the heat resistance of nozzle guide vanes and blades. In specialized applications, nozzle guide vanes and blades are being made entirely of ceramic, thus, accepting even higher gas entry temperatures.

Ceramic materials are superior to metal in high-temperature capability and have a low linear thermal expansion coefficient. But, on the other hand, ceramic materials have negative drawbacks such as low fracture toughness.

When a ceramic structure is used to replace a metallic part or is combined with a metallic one, it is necessary to avoid excessive thermal stresses generated by an uneven temperature distribution or the difference between their linear thermal expansion coefficients. The ceramic components' different chemical composition, physical property and coefficient of thermal expansion to that of a metallic supporting structure result in undesirable stresses. A major portion of these stresses is thermal stress, which will be set up within the nozzle guide vanes and/or blades and between the nozzle guide vanes and/or blades and their supports when the engine is operating.

Furthermore, conventional nozzle and blade designs which are made from a metallic material are capable of absorbing or resisting these thermal stresses. The chemical composition of ceramic nozzles and blades do not have the desired characteristics to absorb or resist the thermal stresses. If the stress occurs in a tensile stress zone of the nozzle or blade a catastrophic failure may occur.

The present invention is directed to overcome one or more of the problems as set forth above.

DISCLOSURE OF THE INVENTION

In one aspect of the invention, a turbine nozzle and shroud assembly includes an outer shroud defining an inner surface having a plurality of recesses therein. An inner shroud is positioned radially within the outer shroud and defines a first end, a second end, an inner surface having a plurality of recesses therein and an outer surface. A plurality of segmented vanes have a first end and a second end positioned within one of the plurality of recesses within the outer shroud and the inner shroud.

BEST MODE FOR CARRYING OUT THE INVENTION

Figure 1:
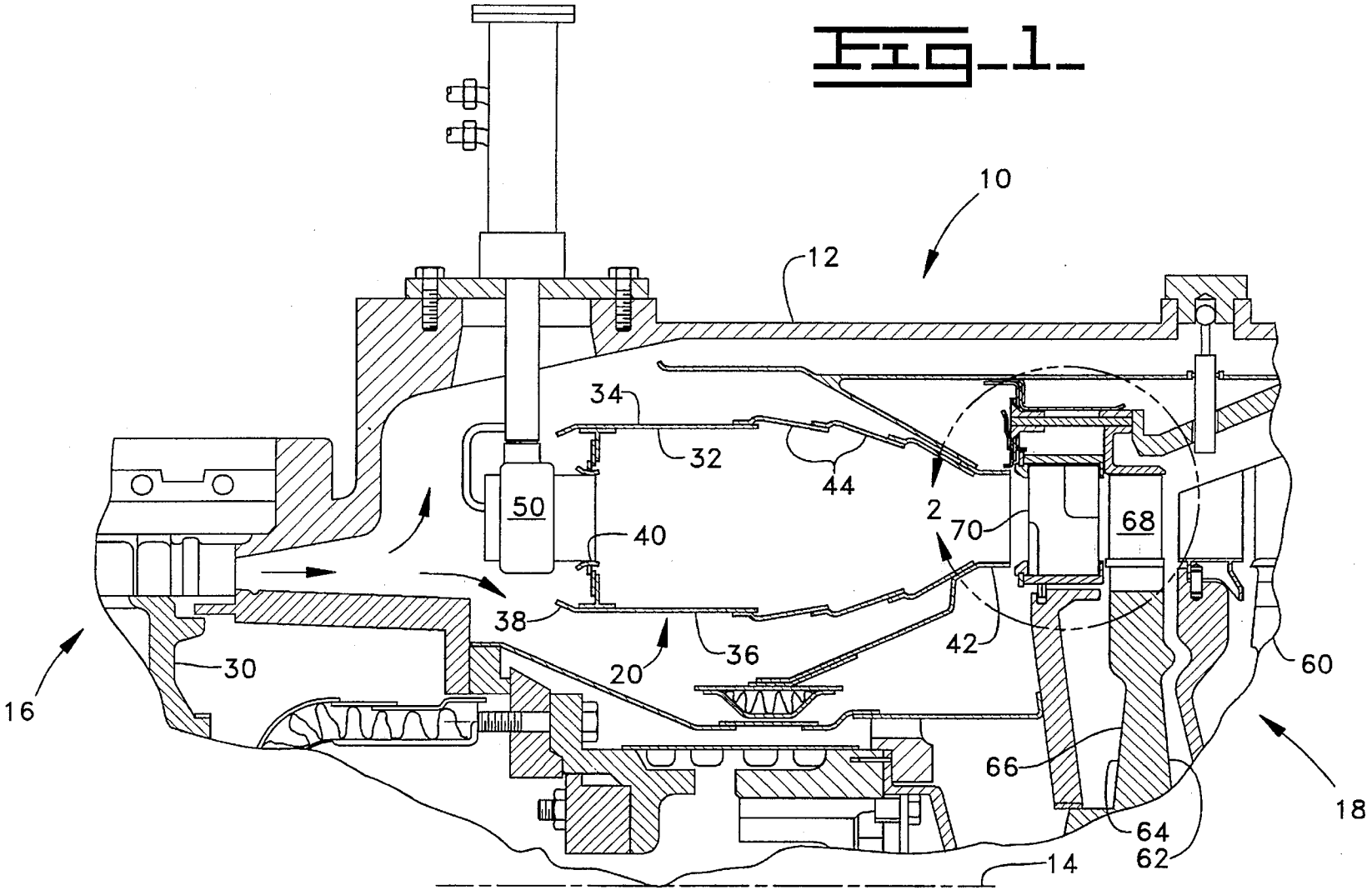
FIG. 1 is a partial side view of a gas turbine engine shown in section for illustration convenience embodying the present invention with portions.

Referring to FIG. 1, a gas turbine engine 10 is shown. The gas turbine engine 10 has an outer housing 12 having a central axis 14. Positioned in the housing 12 and centered about the axis 14 is a compressor section 16, a turbine section 18 and a combustor section 20 positioned operatively between the compressor section 16 and the turbine section 18.

When the engine 10 is in operation, the compressor section 16, which in this application includes an axial staged compressor 30 or, as an alternative, a radial compressor or any source for producing compressed air, causes a flow of compressed air which has at least a part thereof communicated to the combustor section 20 and another portion used for cool components of the gas turbine engine 10. The combustor section 20, in this application, includes an annular combustor 32. The combustor 32 has a generally cylindrical outer shell 34 being coaxially positioned about the central axis 14, a generally cylindrical inner shell 36, an inlet end 38 having a plurality of generally evenly spaced openings 40 therein and an outlet end 42. In this application, the combustor 32 is constructed of a plurality of generally conical segments 44. Each of the openings 40 has an injector 50 positioned therein. As an alternative to the annular combustor 32, a plurality of can type combustors could be incorporated without changing the essence of the invention.

The turbine section 18 includes a power turbine 60 having an output shaft, not shown, connected thereto for driving an accessory component, such as a generator. Another portion of the turbine section 18 includes a gas producer turbine 62 connected in driving relationship to the compressor section 16. The gas producer turbine 62 includes a turbine assembly 64 being rotationally positioned about the central axis 14. The turbine assembly 64 includes a disc 66 having a plurality of blades 68 attached therein in a conventional manner.

Figure 2:
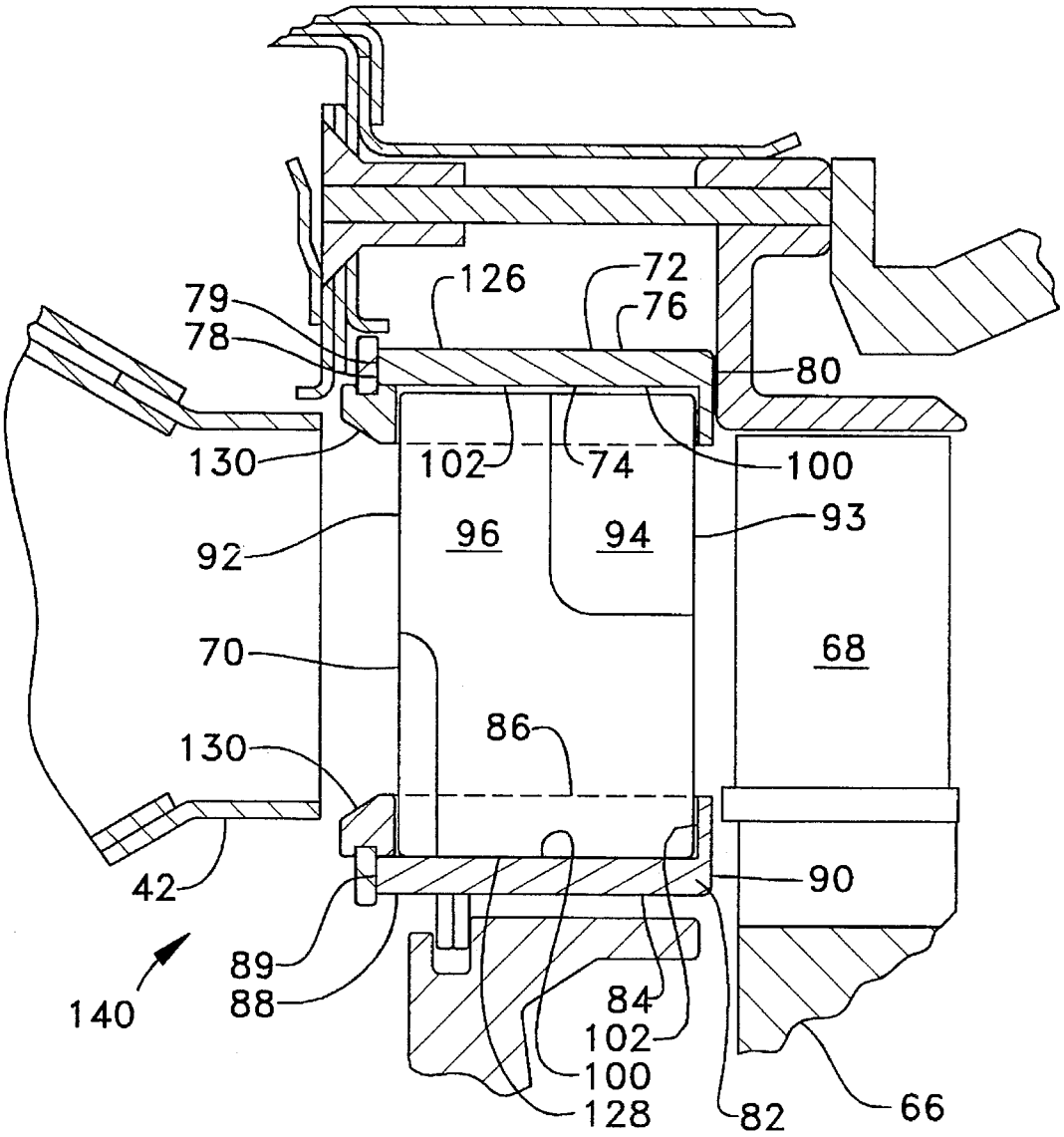
FIG. 2 is an enlarged sectional view of a portion of the gas turbine engine having a segmented airfoil turbine nozzle and shroud assembly as taken generally within line 2 of FIG. 1.

As best shown in FIG. 2, positioned adjacent the outlet end 42 of the combustor 32 and in flow receiving communication therewith is a first stage airfoil turbine nozzle and shroud assembly 70. The turbine nozzle and shroud assembly 70 includes a multi-piece outer shroud 72 defining a radial inner surface 74, a radial outer surface 76, a first end 78 defining a protruding flange 79 thereon and a second end 80. Also included is a multi-piece inner shroud 82 defining a radial inner surface 84, a radial outer surface 86, a first end 88 defining a protruding flange 89 thereon and a second end 90, and a plurality of segmented vanes 92 interposed the outer shroud 72 and the inner shroud 82. As an alternative, each of the outer shroud 72 and the inner shroud 82 could be of a single piece or as another alternative could be made of a metallic material without changing the essence of the invention. In this application, each of the plurality of segmented vanes 92, the outer shroud 72 and the inner shroud 82 have a preestablished rate of thermal expansion being less than the rate of thermal expansion of the metallic components of the engine 10 but are generally equal to the thermal expansion rate of each other. And, each of the plurality of segmented vanes 92 includes a plurality of generally vertically separated segments 93 forming a first vane segment 94 and a second vane segment 96. Each of the first vane segments 94 and the second vane segments 96 are positioned in functional relationship one to another and to the outer shroud 72 and the inner shroud 82.

In this application, each of the multi-piece outer and inner shrouds 72,82 include a plurality of recesses 100 therein. Each of the plurality of recesses 100 has a preestablished contour 102 defining a generally tear drop configuration and a preestablished depth extending from the inner surface 74 of the outer shroud 72 and the outer surface 86 of the inner shroud 82 respectively.

Figure 3:
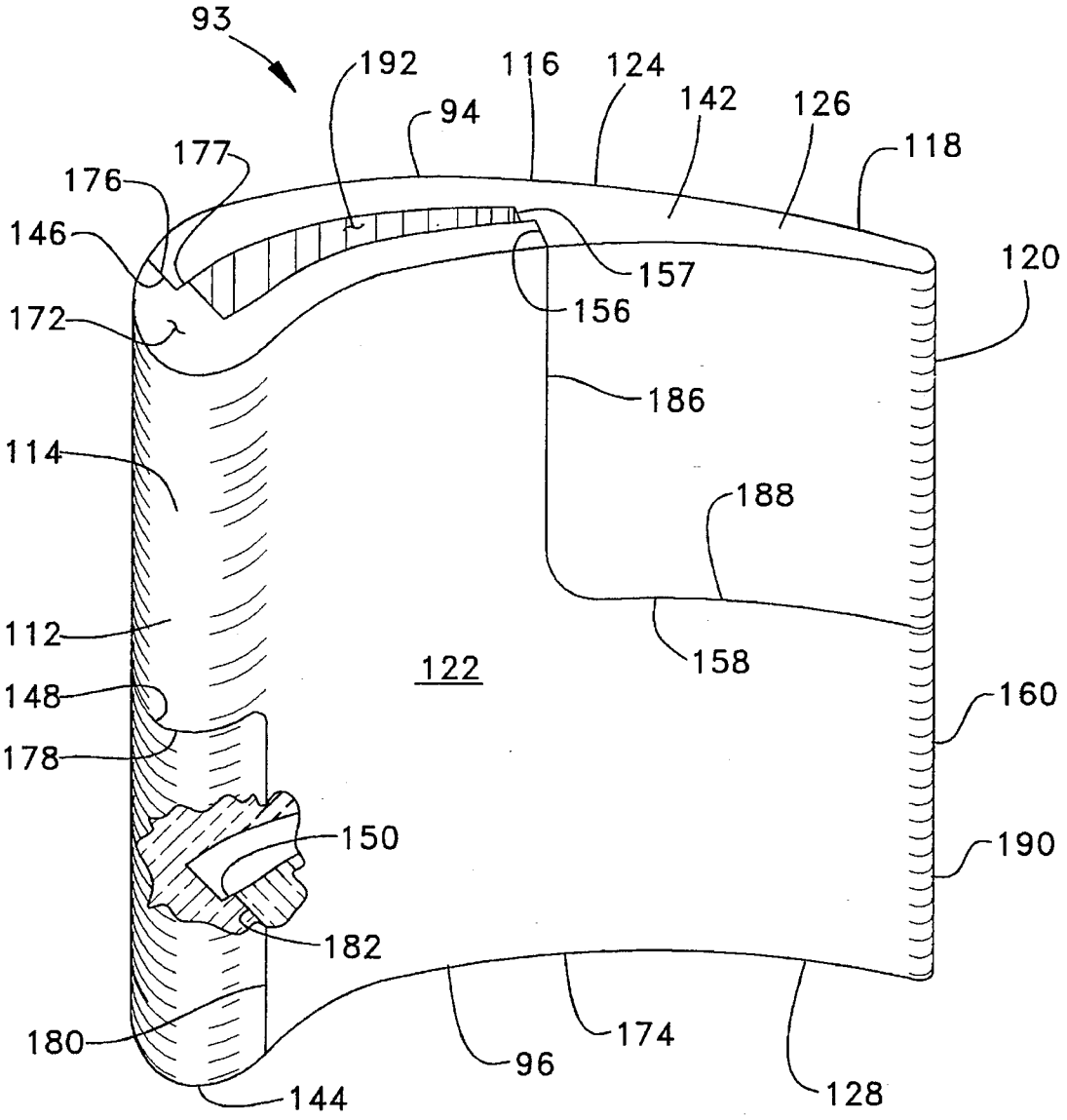
FIG. 3 is an enlarged isometric view of a segmented vane or airfoil.
Figure 4:
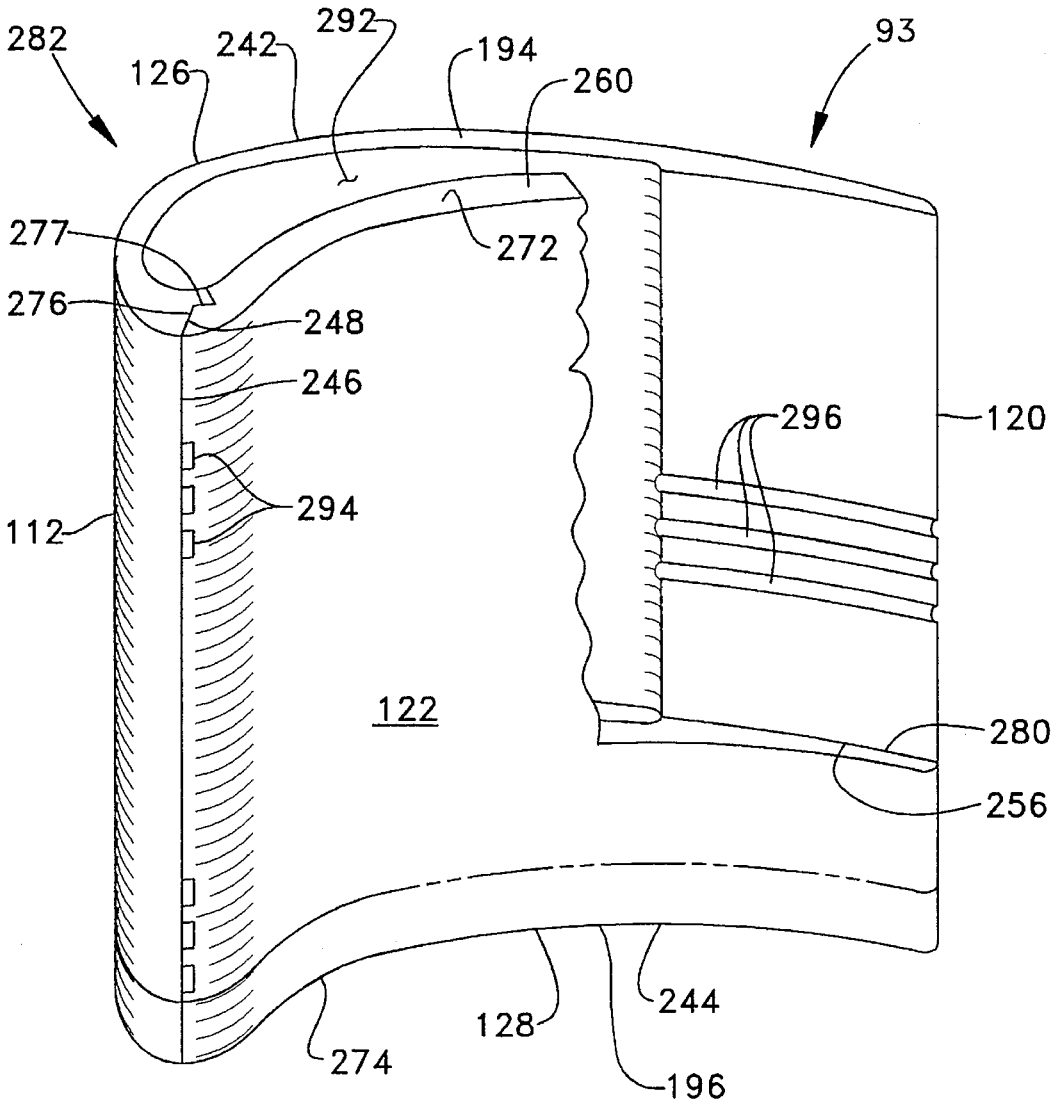
FIG. 4. is an enlarged isometric view of an alternative segmented vane or airfoil.

As best shown in FIGS. 3 and 4, each of the plurality of segmented vanes 92 have a generally tapered or tear drop cross-sectional area. For example, near the outlet end 42 of the combustor 32 at a leading edge 112 the cross-section of the vanes 92 have a rounded nose portion 114 which blendingly connects with a central portion 116 and blendingly connects with an elongated tail portion 118 which terminates at a trailing edge 120. Each of the plurality of segmented vanes 92 define a concave reaction side 122 for directing the flow of combustion gases into the power turbine 62 and a convex reaction side 124. Each of the plurality of segmented vanes 92 has a first end portion 126, which in this application, has a portion thereof nested in the preestablished contour of the individual recess 100 in the outer shroud 72 and a second end portion 128, which in this application, has a portion thereof nested in the preestablished contour of the individual recess 100 in the inner shroud 82. The preestablished contour 102 of each of the plurality of recesses 100 is generally in contacting relationship with the respective portion of the first end portion 126 and the second end portion 128. The trailing edge 120 abuts the inner and outer shrouds 82,72 near the second ends 90,80. A pair of retaining rings 130 are positioned near the first ends 88,78 of the inner and outer shrouds 82,72 respectively and are recessed within the respective flange 89,79. Thus, the first vane segment 94 and the second vane segment 96 are effectively retained within the respective recess 100 and form a unitary airfoil 140.

As best shown in FIG. 3, the first vane segment 94 of the vertical separated segments 93 is defined by a generally flat first end 142 and a generally flat second end 144. Near the leading edge 112 and extending from the first end 142 toward the second end 144 is a first top vertical portion 146 which terminated intermediate the first and second ends 142,144. Extending horizontally toward and intersecting with the leading edge 112 from the termination point of the first top vertical portion 146 and along the convex reaction side 124 is a first horizontal portion 148. The first horizontal portion 148 further extends horizontally along the leading edge 112 and into the concave reaction side 122 and terminates within the concave reaction side 122. Extending from the first horizontal portion 148 to the second end 144 is a first bottom vertical portion 150. Each of the first top vertical portion 146, the first horizontal portion 148 and the first bottom vertical portion 150 are blendingly connected. Intermediate the leading edge 112 and the trailing edge 120 and extending from the first end 142 toward the second 144 is a second top vertical portion 156 defining a first recess 157. The second top vertical portion 156 terminates intermediate the first and second ends 142,144. Extending horizontally toward and intersecting with the trailing edge 120 from the terminal point of the second top vertical portion 156 and along the concave surface side 122 is a second horizontal portion 158. Extending from the second horizontal portion 158 to the second end 144 is a second bottom vertical portion 160. Each of the second top vertical portion 156, the second horizontal portion 158 and the second bottom vertical portion 160 are blendingly connected.

As further shown in FIG. 3, the second vane segment 96 of the vertical separated segments 93 is defined by a generally flat first end 172 and a generally flat second end 174. Near the leading edge 112 and extending from the first end 172 toward the second end 174 is a first top vertical portion 176 defining a first recess 177. The first top vertical portion 176 terminates intermediate the first and second ends 172, 174. Extending horizontally toward and intersecting with the leading edge 112 from the termination point of the first top vertical portion 176 and along the convex reaction side 124 is a first horizontal portion 178. The first horizontal portion 178 further extends horizontally along the leading edge 112 and into the concave reaction side 122 and terminates within the concave reaction side 122. Extending from the first horizontal portion 178 to the second end 174 is a first bottom vertical portion 180 defining a second recess 182. Each of the first top vertical portion 176, the first horizontal portion 178 and the first bottom vertical portion 180 are blendingly connected. Intermediate the leading edge 112 and the trailing edge 120 and extending from the first end 172 toward the second end 174 is a second top vertical portion 186. The second top vertical portion 186 terminates intermediate the first and second ends 172,174. Extending horizontally toward and intersecting with the trailing edge 120 from the terminal point of the second top vertical portion 186 and along the concave surface side 122 is a second horizontal portion 188. Extending from the second horizontal portion 188 to the second end 144 is a second bottom vertical portion 190. Each of the second top vertical portion 186, the second horizontal portion 188 and the second bottom vertical portion 190 are blendingly connected.

As can be seen in FIG. 3, the assembly of the first vane segment 94 with the second vane segment 96 results in a cavity 192 being formed therein. The cavity 192 is the result of the manufacturing technique which defines a preestablished wall thickness as a result of the material being used to form the first vane segment 94 and the second vane segment 96. As an alternative, the cavity 192 can be used for supplemental cooling if desired.

As best shown in FIG. 4, an alternative vertically separated segment 93 is disclosed. A first vane segment 194 of the vertical separated segments 93 is defined by a generally flat first end 242 and a generally flat second end 244. Near the leading edge 112 and extending from the first end 242 to the second end 244 is a first vertical portion 246 which extends the entire length of the airfoil segment. The first vertical portion 246 defines a recess 248 therein. Intermediate the leading edge 112 and the trailing edge 120 and extending from the first end 242 to the second 244 is a second vertical portion 256. The second vertical portion 256 horizontally extends intermediate the leading edge 112 and the trailing edge 120 and extends to the trailing edge 120. As further shown in FIG. 4, a second vane segment 260 of the vertical separated segments 93 is defined by a generally flat first end 272 and a generally flat second end 274. Near the leading edge 112 and extending from the first end 272 to the second end 274 is a first vertical portion 276 defining a recess 277. Intermediate the leading edge 112 and the trailing edge 120 and extending from the first end 272 to the second 274 is a second vertical portion 280. The second vertical portion 280 horizontally extends intermediate the leading edge 112 and the trailing edge 120 and extends to the trailing edge 120. As a further alternative, a cooling passage 282 is provided for cooling the airfoil. The assembly of the first vane segment 194 with the second vane segment 196 results in a cavity 292 being formed therein. The cavity 292 is the result of the manufacturing technique which defines a preestablished wall thickness as a result of the material being used to form the first vane segment 194 and the second vane segment 196. As an alternative in this application, the cavity 292 is used for supplemental cooling. For example, a plurality of openings 294 near the leading edge 112 in the concave reaction side 122. The plurality of openings 294 are positioned intermediate the first end 272 and the second end 274 and extend horizontally from the leading edge 112 along the surface of the first vertical portion 276 of the second vane segment 260 and communicate with the cavity 292. A plurality of passages 296 are positioned intermediate the first end 272 and the second end 274 and extend horizontally from the trailing edge 120 along the surface of the second vertical portion 280 of the second vane segment 260 and communicate with the cavity 292. As a further alternative the plurality of openings 294 and the plurality of passages 296 could be formed in the first vane segment 194 without changing the essence of the invention.

Thus, a turbine nozzle and shroud assembly 70 having a segmented vane 92 is provided to compensate for thermal induced stress. The plurality of vertically separated segments 93 allows the segment 94,96 of the segmented vane nearest the inner shroud 82 and the outer shroud 72 to operate at a cooler temperature while the center most portion of the vane can operate at a higher temperature without having critically high thermally induced stresses therein.

INDUSTRIAL APPLICABILITY

In use, the gas turbine engine 10 is started and allowed to warm up and is used in any suitable power application. As the demand for load or power is increased, the engine 10 output is increased by increasing the fuel and subsequent air resulting in the temperature within the engine 10 increasing. The components used to make up the turbine nozzle vane assembly 70 and the attachment components, being of different materials and having different rates of thermal expansion, grow at different rates and the forces resulting therefrom and acting thereon must be structurally compensated for to increase life and efficiency of the gas turbine engine. The structural arrangement of the turbine nozzle and shroud assembly 70 being made of a ceramic material requires that the turbine nozzle and shroud assembly 70 be generally isolated from the conventional materials and mounting designs. The structural characteristics of the segmented vanes 92, being made of a ceramic material, further complicates the design since thermal stresses within the vanes 92 must be compensated for to insure sufficient life of the components.

For example, the turbine nozzle and shroud assembly 70 which is in direct contact and aligned with the mainstream hot gases from the combustor 42 is suspended from the metallic components of the engine 10 in a convention manner. Thermal expansion is compensated for by using a plurality of vertically segmented vane segments 92. Each of the segments can move thermally independently relative to the other segments. For example, the hot combustion gas passing near the inner and outer shroud 82,72 dissipate a greater amount of heat to the inner and outer shroud 82,72 since these components are attached to cooler engine components and are in turn cooler. Thus, the vane portion nearest to the inner and outer shroud 82,72 will be cooler than the vane portion nearest the center between the inner and outer shroud 82,72. With the vertically segmented vane 92, the first vane segment 94,194 can expand and contract a small amount due to the relative location to the outer shroud 72 which is relatively cool. The second vane segment 96,196 can also expand and contract a small amount due to the relative location to the inner shroud 82 which is relatively cool.

Thus, in view of the foregoing, it is readily apparent that the structure of the present invention results in the internal stress in the tensile stressed region of each of the plurality of vanes 88 being reduced. The general reduction of the tensile stresses reduces the possibility of catastrophic failure of each of the plurality of ceramic turbine nozzle vanes 92. Furthermore, the relative difference in thermal expansion between the metallic components and the ceramic components and the mounting therebetween has been compensated for by use of vertically segmented vane segments 92.

Other aspects, objects and advantages of this invention can be obtained from a study of the drawings, the disclosure and the appended claims.

We claim:

1. A turbine nozzle and shroud assembly comprising:

an outer shroud defining an inner surface having a plurality of recesses therein;

an inner shroud positioned radially within said outer shroud and defining a first end, a second end, an inner surface and an outer surface having a plurality of recesses therein; and a plurality of segmented vanes having a first end and a second end positioned within one of the plurality of recesses within the outer shroud and the inner shroud, each of said plurality of segmented vanes having a leading edge and a trailing edge and being defined by a first vane segment and a second vane segment each of said first vane segment and second vane segment extending generally between said leading edge and said trailing edge.

2. The turbine nozzle and shroud assembly of claim 1 wherein said first vane segment and second vane segment are generally vertically separated.

3. The turbine nozzle and shroud assembly of claim 1 wherein said plurality of segmented vanes have a preestablished rate of thermal expansion and said outer shroud and said inner shroud have a rate of thermal expansion being generally equal to the rate of thermal expansion of the plurality of segmented vanes.

4. The turbine nozzle and shroud assembly of claim 1 wherein said plurality of recesses define a preestablished contour having a generally tear drop configuration in each of the inner shroud and the outer shroud.

5. The turbine nozzle and shroud assembly of claim 4 wherein said plurality of segmented vanes have a generally tear drop configuration in which each of the first end and the second end are in contacting relationship with the tear drop configuration of the respective one of the plurality of recesses.

6. The turbine nozzle and shroud assembly of claim 1 wherein when assembled said first vane segment and said second vane segment form a cavity therebetween.

7. The turbine nozzle and shroud assembly of claim 6 wherein at least one of said first vane segment and said second vane segment have a plurality of openings extending from the leading edge and communicating with the cavity and a plurality of passages extending from the trailing edge and communicating with the cavity.

8. The turbine nozzle and shroud assembly of claim 6 wherein at least one of said first vane segment and said second vane segment have a plurality of openings extending from the leading edge and communicating with the cavity.

9. The turbine nozzle and shroud assembly of claim 6 wherein at least one of said first vane segment and said second vane segment have a plurality of passages extending from the trailing edge and communicating with the cavity.

10. The turbine nozzle and shroud assembly of claim 1 wherein one of said first vane segment and said second vane segment include a vertical portion defining a recess.

11. The nozzle and shroud assembly of claim 1 where said first vane segment and said second vane segment have a portion of said segments being defined by a horizontal portion.

* * * * *